US007038369B2

(12) United States Patent
Choi

(10) Patent No.: US 7,038,369 B2
(45) Date of Patent: May 2, 2006

(54) REINFORCING BAND STRUCTURE FOR CATHODE RAY TUBE

(75) Inventor: Oh Yong Choi, Gumi-si (KR)

(73) Assignee: LG Philips Displays Korea Co., Ltd., Gyeongsangbuk-Do (KR)

( * ) Notice: Subject to any disclaimer, the term of this patent is extended or adjusted under 35 U.S.C. 154(b) by 225 days.

(21) Appl. No.: 10/703,577

(22) Filed: Nov. 10, 2003

(65) Prior Publication Data

US 2004/0140752 A1 Jul. 22, 2004

(30) Foreign Application Priority Data

Jan. 21, 2003 (KR) ..... 10-2003-0004067

(51) Int. Cl.
*H01J 31/00* (2006.01)

(52) U.S. Cl. ..... 313/477 R; 313/402; 313/407

(58) Field of Classification Search ..... 313/477 R, 313/482, 402, 406, 407; 348/821–822; 220/2.1 A, 220/2.3 A
See application file for complete search history.

(56) References Cited

U.S. PATENT DOCUMENTS 6,342,760 B1 * 1/2002 Mashimo et al. ..... 313/477 R

FOREIGN PATENT DOCUMENTS

CN 1069145 A 2/1993
JP 11-329303 11/1999

* cited by examiner

*Primary Examiner*—Joseph Williams
*Assistant Examiner*—Kevin Quarterman
(74) *Attorney, Agent, or Firm*—Birch, Stewart, Kolasch & Birch, LLP

(57) ABSTRACT

A cathode ray tube is mounted with a reinforcing band for improving landing stability of electron beams and howling of shadow mask and reinforcing an explosion-proof function.

17 Claims, 9 Drawing Sheets

REINFORCING BAND STRUCTURE FOR CATHODE RAY TUBE

This Nonprovisional application claims priority under 35 U.S.C. § 119(a) on Patent Application No. 10-2003-0004067 filed in KOREA on Jan. 21, 2003, the entire contents of which are hereby incorporated by reference.

BACKGROUND OF THE INVENTION

1. Field of the Invention

The present invention relates in general to a cathode ray tube, more particularly, to a cathode ray tube mounted with a reinforcing band for improving landing stability of electron beams and howling of shadow mask and reinforcing an explosion-proof function.

2. Discussion of the Background Art

FIG. 1 illustrates the structure of a related art cathode ray tube, and FIG. 2 is a cross-sectional view taken along line A–A' in FIG. 1.

As shown in FIGS. 1 and 2, the related cathode ray tube includes a panel 3 having a fluorescent screen 6 formed on an inner surface, a funnel 5 connected to a seal edge portion 4 of a skirt portion 2 of the panel 3, an electron gun 14 mounted on a neck portion 12 of the funnel 5, emitting electron beams 13, deflection yokes 15 for deflecting the electron beams 13 emitted from the electron gun 14, a shadow mask 8 for selecting colors of the electron beams 13, and a mask frame 9 for supporting the shadow mask 8.

The mask frame 9 is connected to a stud pin 10 formed on the skirt portion 2 of the panel 3 by means of mask springs 11.

Also, a reinforcing band 17 straps around an outer peripheral portion of the skirt portion 2 of the panel 3 in order to prevent CRT implosion by external impacts, and a lug 18 to be incorporated in a TV set is also formed on the outer peripheral portion of the skirt portion 2 of the panel.

The Z—Z line in FIG. 1 indicates a tube axis.

As depicted in FIG. 3, the reinforcing band 17 is usually mounted on a portion where the stud pins 10 are formed.

However, when the reinforcing band 17 is mounted on where the stud pin 10 is formed, a howling phenomenon occurs to the shadow mask 8 due to voice vibrations generated from a speaker mounted on the outside of the cathode ray tube.

To be more specific, the voice vibrations generated from the speaker are transmitted to the reinforcing band 17, and to the stud pin 10 formed inside of the skirt portion 2 of the panel 3, and eventually to the mask frame 9 and the shadow mask 8 connected to the stud pin 10.

As a result, the howling phenomenon occurs to the shadow mask 8, and electron beams do not land stably, eventually deteriorating a picture quality.

As FIG. 4 shows, clamping power of the reinforcing band 17 is influenced by the outer peripheral length of the skirt portion 2 of the panel 3 and the inner peripheral length of the reinforcing band 17. The clamping power of the reinforcing band 17 influences in turn picture quality characteristics of the cathode ray tube.

FIG. 4 illustrates clamping power errors of the reinforcing band. More details on the drawing are now followed.

Referring to FIG. 4, Lm denotes an inner peripheral length of the reinforcing band 17, $\pm\beta$ denotes tolerance errors in a manufacturing process for the reinforcing band, Lg denotes an outer peripheral length of the skirt portion 2, and $\pm\alpha$ denotes tolerance errors in a manufacturing process for the skirt portion. Here, the reinforcing band 17 has a maximum clamping power at a point Pa, and a maximum clamping power at a point Pb.

Generally, the reinforcing band 17 is expanded by heating. The reinforcing band 17 is welded to the skirt portion by stress applied thereon when the reinforcing band is strapped around the outer peripheral portion of the skirt portion 2. And, the reinforcing band 17 becomes clamped by cooling. However, depending on temperature and material characteristics, there can be errors, and these errors eventually change the clamping power of the reinforcing band.

Errors of the clamping power of the reinforcing band 17 contribute to the difference in compressive stress and the deviations in landing of electron beams.

After all, a picture quality of the cathode ray tube is severely deteriorated. This problem becomes worse, however, as shown in FIG. 3, if the reinforcing band 17 is mounted on an outer surface of the skirt portion where the stud pin 10 is formed.

In addition, compared to a traditional cathode ray tube having a convex outer surface, an inner surface of radius of curvature (Ri in FIG. 3) of the panel whose outer surface is substantially flat is increased, and this in turn increases the curvature radius of the shadow mask 8, thereby lessening the strength of the shadow mask 8.

Particularly, in case of using tint glass having less than 51% of light transmittance, the difference between a thickness at the central portion (Tp) of the panel and a thickness at the peripheral portion (Tw) of the panel causes about 15 fL of brightness reduction to the peripheral portion. Thus, the thickness at the peripheral portion (Tw) should be reduced.

However, if the peripheral portion of the panel 3 gets thinner, the radius of curvature of the inner surface of the panel 3 is increased, and this causes an increase of the radius of curvature of the shadow mask 8 disposed at a predetermined distance (Tmp) from the inner surface of the panel 3. When these happen, the strength of the shadow mask 8 is lessened, being more subject to the influence of external impacts.

FIG. 5 shows different thicknesses of a panel with and without a tint glass.

Since the thickness at the peripheral portion of a tint glass (Pt) is relatively thinner than a clear glass (Pc), as shown in FIG. 6, the radius of curvature of the inner surface (Ri) of the tilt glass (Pt) is greater than that of the clear class (Pc), and the strength of the shadow mask 8 is lessened even more.

Therefore, the howling phenomenon due to voice vibrations of the speaker, and clamping power difference (error) of the reinforcing band 17 play a more negative role in landing of electron beams.

FIG. 7 describes stress being applied to the inside of a cathode ray tube in vacuum state.

When the inside of the cathode ray tube is in vacuum state, compressive stress ($\sigma c$) is applied to the central portion of the panel 3, and tensile stress ($\sigma t$) is applied to the peripheral and skirt portions of the panel 3.

If the cathode ray tube in such state is broke down by external impacts, fragments of the panel 3 are first sucked into the cathode ray tube because of atmospheric pressure, and split to the outside later.

The above phenomenon is called 'accidental implosion phenomenon'. Thus, the reinforcing band 17 constricts the skirt portion 2 to minimize splitting of glass fragments at the time of CRT implosion.

FIG. 8 shows how stress changes according to a reinforcing band mounted on the skirt portion.

Referring to FIG. 8, if the reinforcing band 17 is mounted on a skirt portion 2 of a panel having a predetermined outer surface radius of curvature (Ro), clamping power (P) of the reinforcing band 17 acts upon the skirt portion 2, thereby lessening compressive stress at the central portion of the panel 3.

More specifically, as the compressive stress is lessened by mounting the reinforcing band 17, a variation (hv) of the panel before the reinforcing band 17 is mounted thereon is changed to a variation (hb) of the panel after the reinforcing band 17 is mounted thereon.

What happens here is that the compressive stress is cancelled by the clamping power (P) of the reinforcing band 17. Therefore, even when CRT implosion accidentally occurs due to the lessened compressive stress at the central portion of the panel 3, much less fragments are split outward.

FIG. 9 illustrates how clamping power of a reinforcing band acts upon a skirt portion of a panel.

As depicted in FIG. 9, when the reinforcing band 17 is mounted on the skirt portion 2 of the panel 3 having a predetermined radius of curvature (Ro) on its outer surface, the clamping power (P) of the reinforcing band 17 is divided into a vertical component of power ($\sigma n$) and a horizontal component of power ($\sigma p$), and their resultant power ($\sigma r$) is applied along the curvature radius of the panel 3.

Thus, the compressive stress acting upon the central portion of the panel 3 because of atmospheric pressure is cancelled by the resultant power ($\sigma r$), and as a result, the compressive stress is lessened, as discussed in FIG. 8.

However, the above operation is not always equally applied to a substantially flat outer surface.

FIG. 10 describes changes in stress after mounting a reinforcing band on a panel having a substantially flat outer surface, and FIG. 11 illustrates how clamping power of a reinforcing band acts upon a panel having a substantially flat outer surface.

As shown in FIG. 10, a variation (hb) of compressive stress acting upon a central portion of the panel 3 where the reinforcing band is mounted on the panel having a substantially flat outer surface is rather increased, in contrast with what is shown in FIG. 8.

That is, thanks to the clamping power (P) of the reinforcing band, the compressive stress after mounting the reinforcing band 17 is much improved, compared to before mounting the reinforcing band 17.

This phenomenon occurs because the clamping power (P) of the reinforcing band 17 is divided into a vertical component of power ($\sigma n$) and a horizontal component of power ($\sigma p$), as shown in FIG. 11, and their resultant power ($\sigma r$) is applied to the inward of a cathode ray tube because the outer surface of the panel 3 is substantially flat.

That is to say, it is hard to expect the same effect, namely improving the explosion-proof characteristic of a cathode ray tube, from mounting the reinforcing band 17 on the panel having a substantially flat outer surface with the one on the panel whose outer surface is curved,

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube, capable of presenting a high picture quality by preventing voice vibrations generated by a speaker from being transmitted to a shadow mask Another object of the present invention is to provide a cathode ray tube for preventing deviations in landing of electron beams and deterioration of a picture quality caused by external impacts or stress, as the strength of a shadow mask is weakened by an increase of a radius of curvature of the shadow mask following the trends of using flat panels and tint material for a panel.

Another object of the invention provides a cathode ray tube with an improved explosion-proof function, by mounting a reinforcing band on a panel having a substantially flat outer surface and thereby canceling compressive stress acting upon a central portion of the panel.

The foregoing and other objects and advantages are realized by providing a cathode ray tube including a panel having a skirt portion formed on a peripheral portion of an effective surface and a seal edge portion at an end of the skirt portion connected to a funnel, a stud pin being formed on an inner surface of the skirt portion and a reinforcing band being mounted on an outer surface of the skirt portion, wherein the outer surface of the panel is substantially flat, the inner surface of the panel has a predetermined radius of curvature, a ratio of a distance (b) from the seal edge portion to an end of the reinforcing band to a distance (a) from the seal edge portion to a center of the stud pin satisfies a condition of $1.0<b/a<0.0$.

Another aspect of the invention provides a cathode ray tube including a panel having a skirt portion formed on a peripheral portion of an effective surface and a seal edge portion at an end of the skirt portion connected to a funnel, a stud pin being formed on an inner surface of the skirt portion and a reinforcing band being mounted on an outer surface of the skirt portion, wherein the outer surface of the panel is substantially flat, the inner surface of the panel has a predetermined radius of curvature, transmittance at a central portion of the panel ranges from 45 to 75%, a thickness of the reinforcing band is less than 2.0 mm, and a ratio of a distance (b) from the seal edge portion to an end of the reinforcing band to a distance (a) from the seal edge portion to a center of the stud pin satisfies a condition of $1.2<b/a<1.8$ Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

Figure 1:
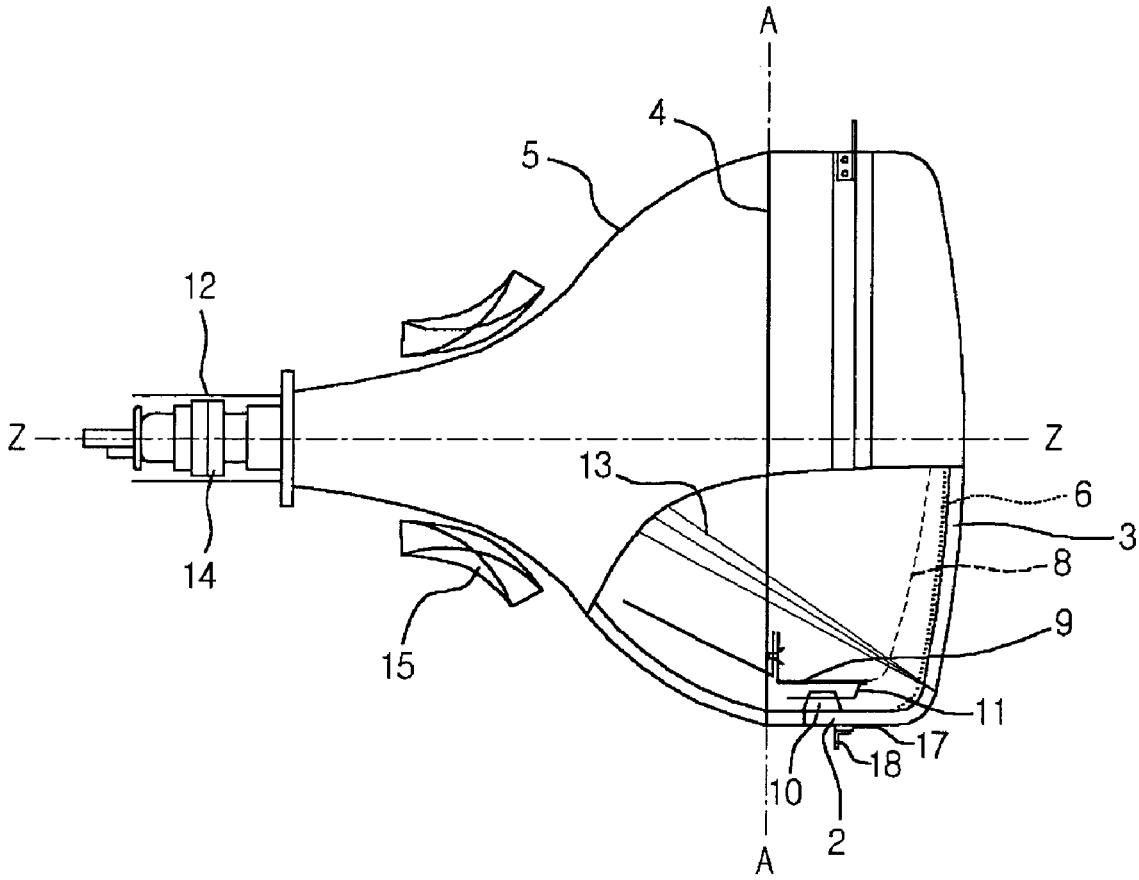
Fig.1 Related Art
FIG. 1 illustrates the structure of a related art cathode ray tube.
Figure 2:
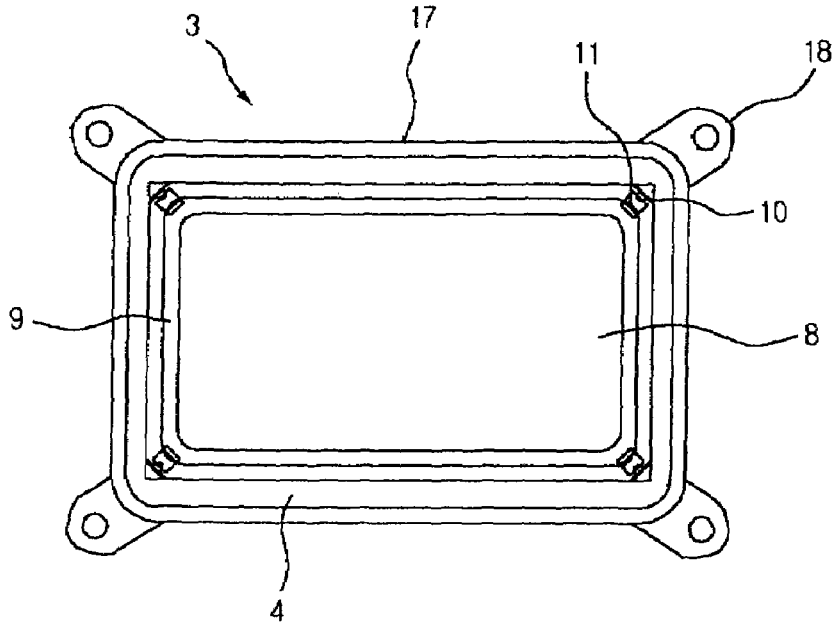
Fig.2 Related Art
FIG. 2 is a cross-sectional view taken along line A–A' in FIG. 1.
Figure 3:
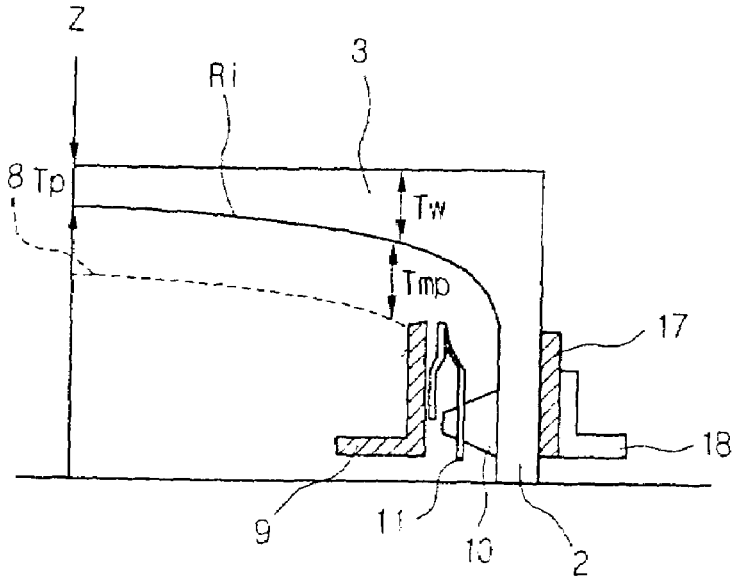
Fig.3 Related Art
FIG. 3 is a cross-sectional view of a portion on which a related art reinforcing band is mounted.
Figure 4:
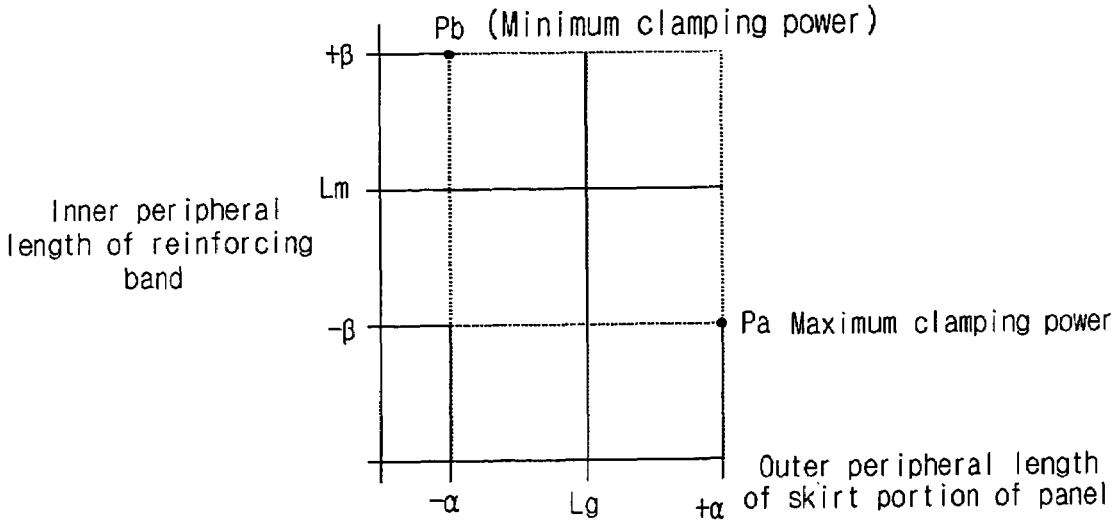
Fig.4 Related Art
FIG. 4 illustrates clamping power errors of a reinforcing band.
Figure 5:
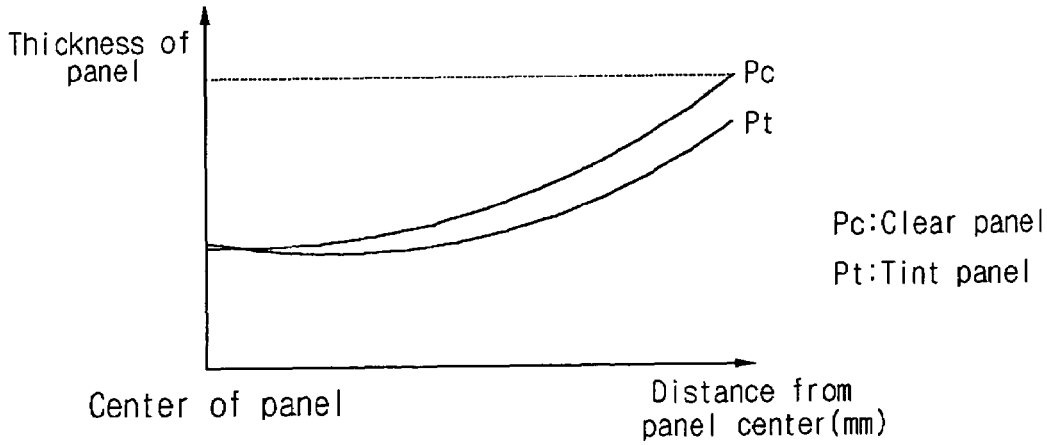
Fig.5 Related Art
FIG. 5 shows different thicknesses of a panel in cases of using a tilt glass and a clear glass.
Figure 6:
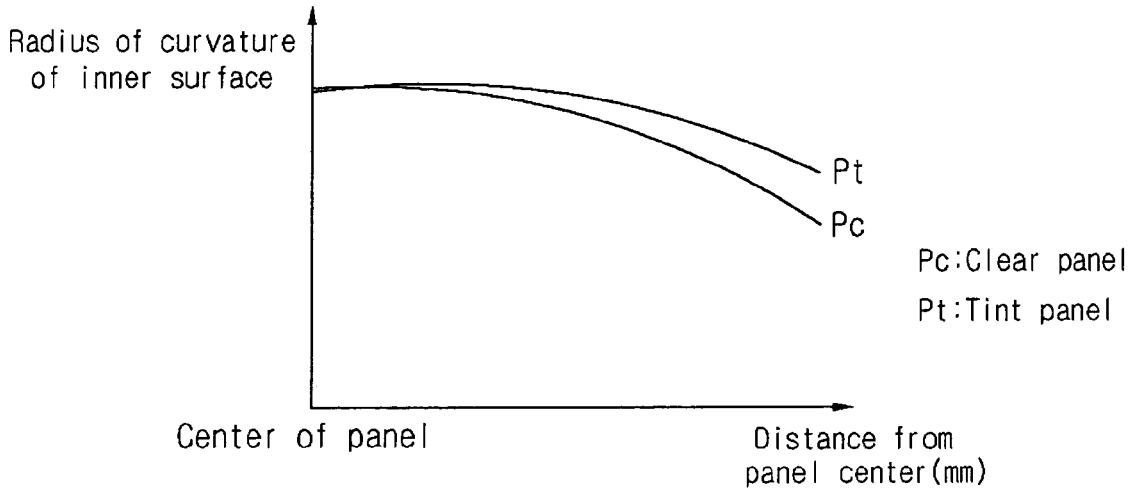
Fig.6 Related Art
FIG. 6 shows radii of curvature of an inner surface of a panel using a tint glass and a clear glass.
Figure 7:
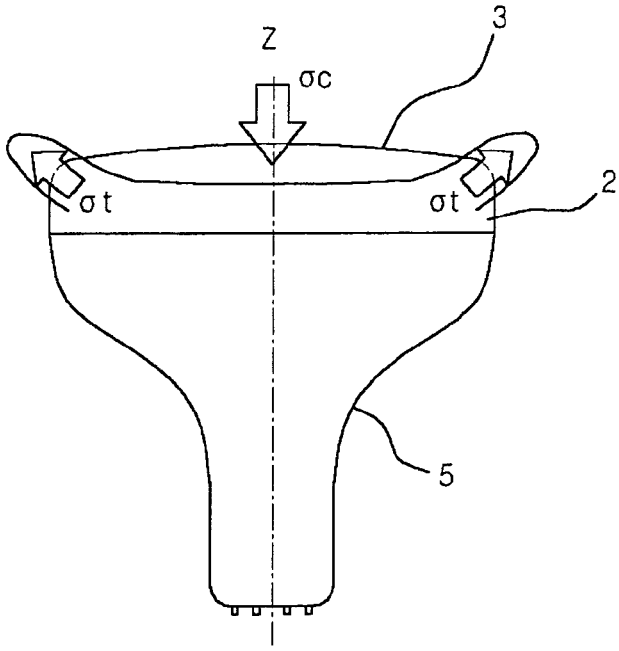
Fig.7 Related Art
FIG. 7 describes stress being applied to the inside of a cathode ray tube in vacuum state.
Figure 8:
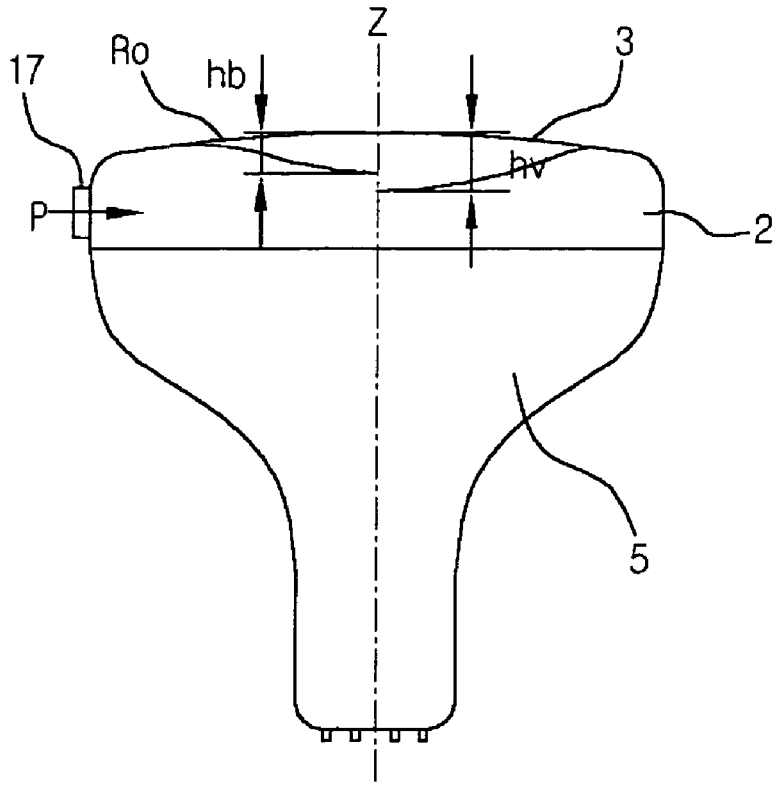
Fig.8 Related Art
FIG. 8 shows how stress changes according to a reinforcing band mounted on the skirt portion.
Figure 9:
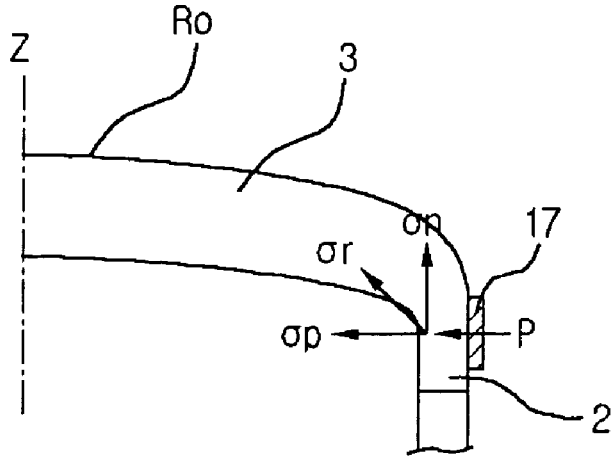
Fig.9 Related Art
FIG. 9 illustrates how clamping power of a reinforcing band acts upon a skirt portion of a panel.
Figure 10:
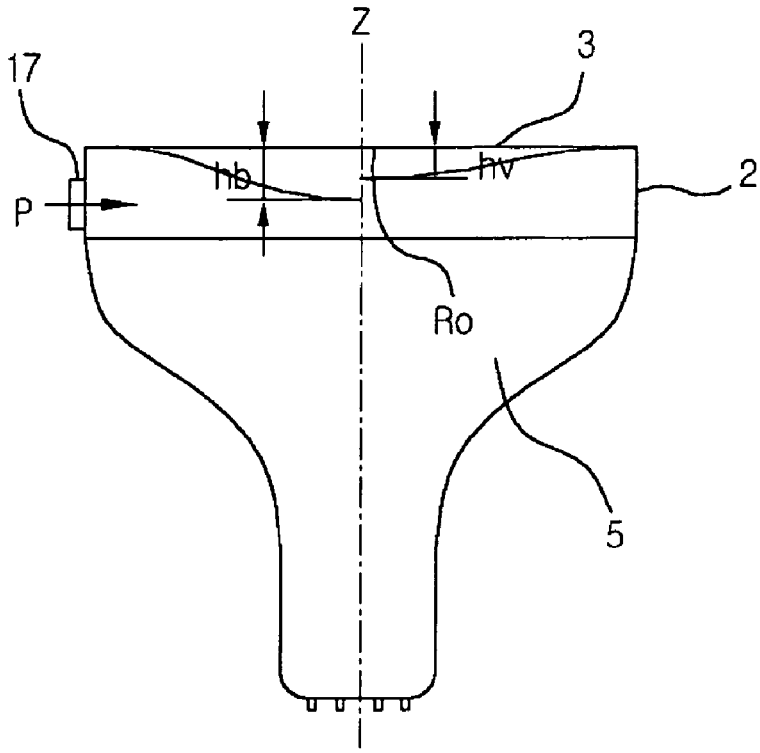
Fig.10 Related Art
FIG. 10 describes changes in stress after mounting a reinforcing band on a panel having a substantially flat outer surface.
Figure 11:
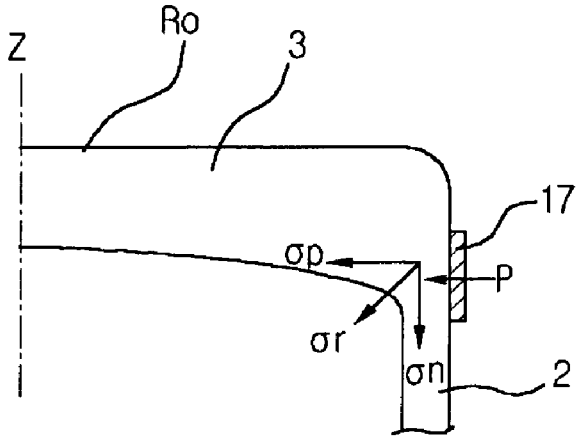
Fig.11 Related Art
FIG. 11 illustrates how clamping power of a reinforcing band acts upon a panel having a substantially flat outer surface.
Figure 12:
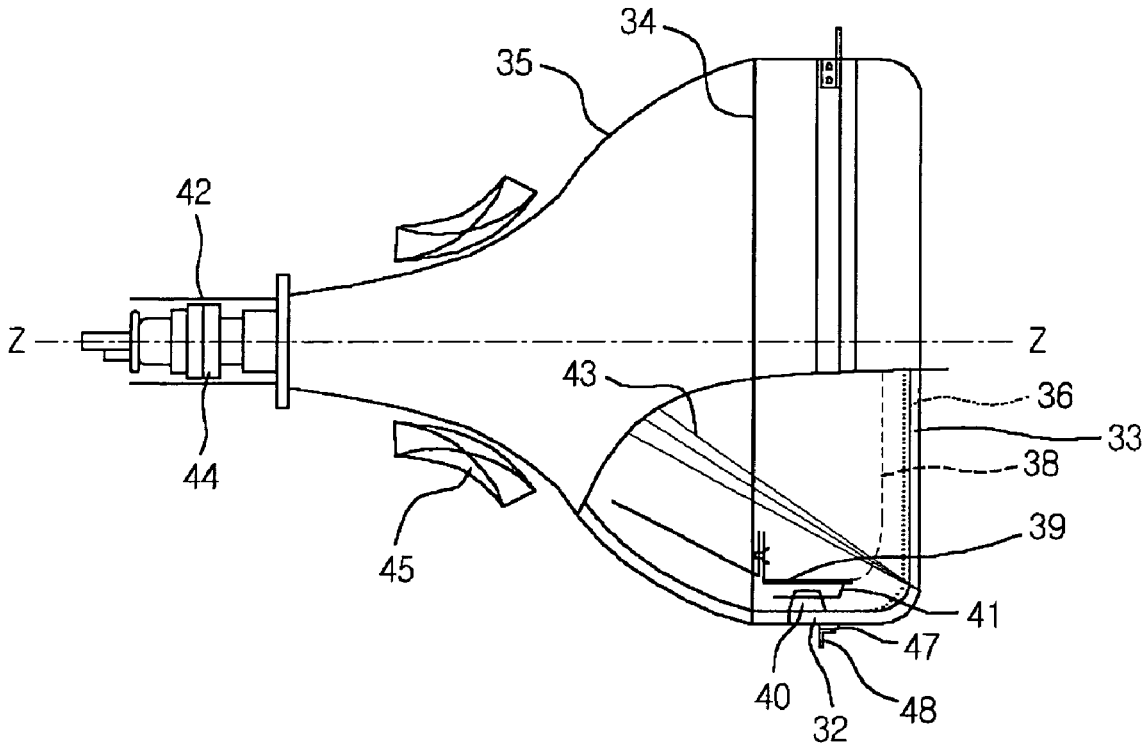
FIG. 12 shows a cathode ray tube according to the present invention.

FIG. 12 is a diagram showing a cathode ray tube according to the present invention.

Referring to FIG. 12, the cathode ray tube of the invention includes a panel 33 having a fluorescent screen 36 formed on an inner surface, a funnel 35 connected to a seal edge portion 34 of a skirt portion 32 of the panel 33, an electron gun 44 mounted on a neck portion 42 of the funnel 35, emitting electron beams 43, deflection yokes 45 for deflecting the electron beams 43 emitted from the electron gun 44, a shadow mask 38 for selecting colors of the electron beams 43, and a mask frame 39 for supporting the shadow mask 38. The mask frame 39 is coupled to a stud pin 40 formed on the skirt portion 32 of the panel 33 by means of mask springs 41. Also, a reinforcing band 47 straps around an outer peripheral portion of the skirt portion 32 of the panel 33 in order to prevent CRT implosion by external impacts, and a lug 48 to be incorporated in a TV set is also formed on the outer peripheral portion of the skirt portion 32 of the panel.

An outer surface of the panel 33 is substantially flat, and an inner surface thereof has a predetermined radius of curvature within a range of 1.2R~8R (1R=1.767× diagonal size of effective surface of panel).

Figure 13:
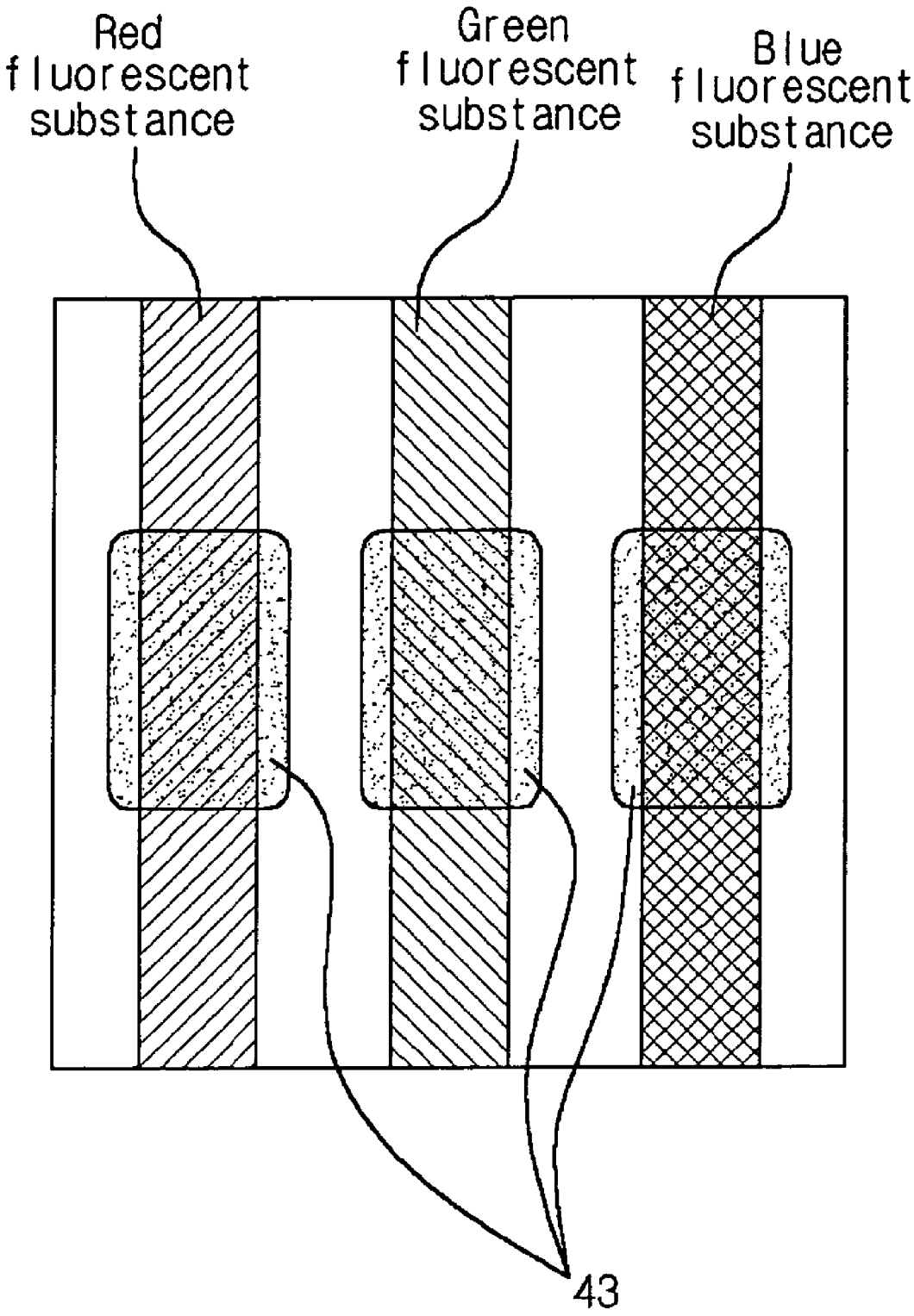
FIG. 13 depicts fluorescent substances layered on an inner surface of a panel, and landing of electron beams therein.

As depicted in FIG. 13, three color (G, B and Y)—fluorescent substances are layered on the inner surface of the panel 33, and as the electron beams 43 are scanned onto each of the fluorescent substances, an image is displayed.

Figure 14:
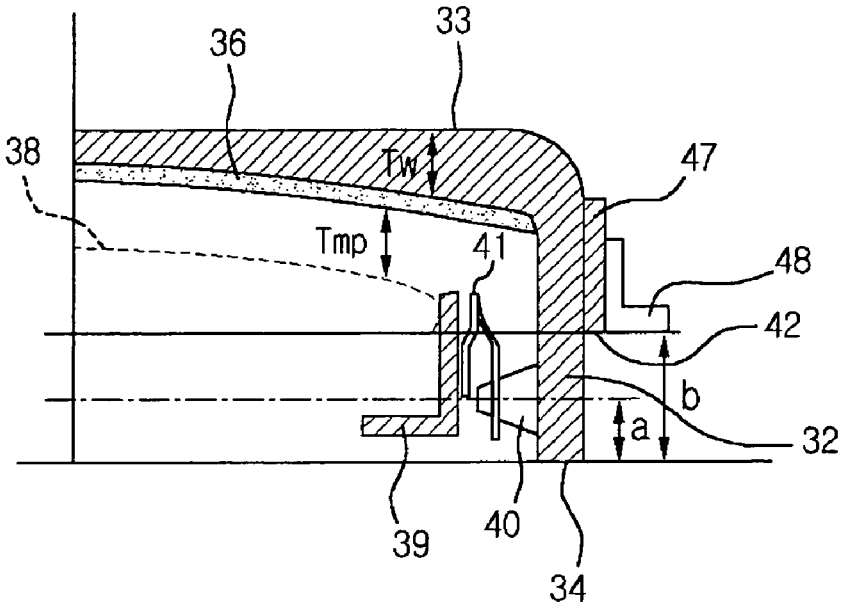
FIG. 14 is an exploded cross-sectional view of a cathode ray tube according to the present invention.

In the exploded cross-sectional view of a cathode ray tube in FIG. 14, 'a' denotes the distance from a seal edge portion 34 to a stud pin 40, and 'b' denotes the distance from the seal edge portion 34 to an end of the reinforcing band 47. Then the reinforcing band 47 is mounted in such a manner to satisfy a condition of 1.0<b/a<2/0.

Table 1 shows how the landing stability of electron beams and the howling characteristic of shadow mask are affected by the diagonal size of the effective surface of the panel in the cathode ray tube according to the invention. Particularly, ○, Δ, X in cited order, indicate conditions of the landing stability and the howling characteristics (i.e. ○: good, Δ: fair, and X: bad).

TABLE 1

| Diagonal size of effective surface of panel (mm) | a (mm) | b (mm) | b/a | Landing stability | Howling characteristic |
|---|---|---|---|---|---|
| 460 | 20 | 15 | 0.75 | X | X |
| | | 20 | 1.0 | X | X |
| | | 30 | 1.5 | X | X |
| | | 40 | 2.0 | Δ | Δ |
| | | 50 | 2.5 | X | X |
| 510 | 21 | 11 | 0.52 | X | X |
| | | 21 | 1.0 | Δ | Δ |
| | | 31.5 | 1.5 | ○ | ○ |
| | | 42 | 2.0 | Δ | Δ |
| | | 52.5 | 2.5 | X | X |
| 680 | 21 | 11 | 0.52 | X | X |
| | | 21 | 1.0 | Δ | Δ |
| | | 31.5 | 1.5 | ○ | ○ |
| | | 42 | 2.0 | Δ | Δ |
| | | 52.5 | 2.5 | X | X |

As is apparent in Table 1, the landing stability and the howling characteristic are good when the diagonal sizes of the effective surface of the panel 33 are 510 mm and 680 mm, and b/a satisfies the condition of 1.0<b/a<2/0.

To be more specific, the landing stability and the howling characteristic are good when the diagonal size of the effective surface of the panel 33 is greater than 480 mm.

Particularly, when b/a satisfies the condition of 1.1<b/a<1.8, the landing stability and the howling characteristic turned out to be good.

More preferably, when b/a satisfies the condition of 1.2<b/a<1.8, the landing stability and the howling characteristic are even better.

Table 2 is provided to compare the landing stability and the howling characteristic in a clear panel and tint panel, each panel having 680 mm of the diagonal size on the effective surface.

TABLE 2

| Diagonal size of effective surface of panel (mm) | Wedge rate (%) | Tmp (mm) | a (mm) | b (mm) | b/a | Landing stability | Howling charac-teristic |
|---|---|---|---|---|---|---|---|
| 680 (Clear) | 220 | 33 | 21 | 11 | 0.5 | X | X |
| | | | | 21 | 1.0 | Δ | Δ |
| | | | | 31.5 | 1.5 | ○ | ○ |
| | | | | 42 | 2.0 | Δ | Δ |
| | | | | 52.5 | 2.5 | X | X |
| 680 (Tint) | 190 | 37 | 21 | 11 | 0.5 | X | X |
| | | | | 21 | 1.0 | Δ | Δ |
| | | | | 31.5 | 1.5 | Δ | Δ |
| | | | | 42 | 2.0 | ○ | ○ |
| | | | | 52.5 | 2.5 | X | X |
| | | | | 63 | 3.0 | X | X |

Referring to the Table 2, in case of the panel 33 using a tint glass, in order to prevent degradation of brightness, a thickness of a peripheral portion (Tw) of the panel 33 is relatively thinner than that of the panel 33 using a clear glass. Hence, the wedge rate of the panel 33 using a tint glass is less than the wedge rate of the panel 33 using a clear glass.

As such, if the thickness of the peripheral portion (Tw) of the panel 33 is reduced, a gap (Imp) from the peripheral portion of the panel 33 to the inner surface of the panel 33 and the shadow mask 38 is increased, and as a result thereof, the radius of curvature of the shadow mask 38 is also increased.

If the radius of curvature of the shadow mask 38 is increased, the strength of the shadow mask 38 is lessened, so even under the same magnitude of voice vibrations, the landing stability of electron beams and the howling characteristic of the shadow mask become worse.

Turning back to Table 2, the landing stability and the howling characteristic are good when b/a of the panel 33 using the tint glass with 190% of wedge rate is used.

This indicates that to improve the landing stability of electron beams and the howling characteristic of the shadow mask the distance (b) from the seal edge portion 34 to the end of the reinforcing band 47 should be increased as the wedge rate is decreased.

As discussed before and as are apparent in Table 1 and Table 2, the reinforcing band 47 should be mounted in such a manner that b/a satisfies the condition of $1.0<b/a<2.0$, wherein 'a' denotes the distance from a seal edge portion 34 to a stud pin 40, and 'b' denotes the distance from the seal edge portion 34 to an end of the reinforcing band 47.

Preferably, transmittance of glass at the central portion of the panel is in range of 45–75%, and the wedge rate is greater than 170%.

In addition, the thickness of the reinforcing band 47 is preferably less than 2.0 mm, in order to reduce total weight and expense of manufacture of the cathode ray tube. If an explosion-proof characteristic is taken into consideration, the thickness of the reinforcing band 47 should be in range of 1.0–1.7 mm though. Also, when the width of the reinforcing band 47 is greater than 40 mm, the explosion-proof characteristic is enhanced.

The clamping power of the reinforcing band 47 can also be improved by setting embossment on the reinforcing band 47. The embossment is preferably set in the longitudinal direction of the reinforcing band 47.

As for the reinforcing band 47, a folded-shaped reinforcing band or a straight line-shaped reinforcing band can be utilized. However, the straight line-shaped reinforcing band 47 is more desired.

Figure 15:
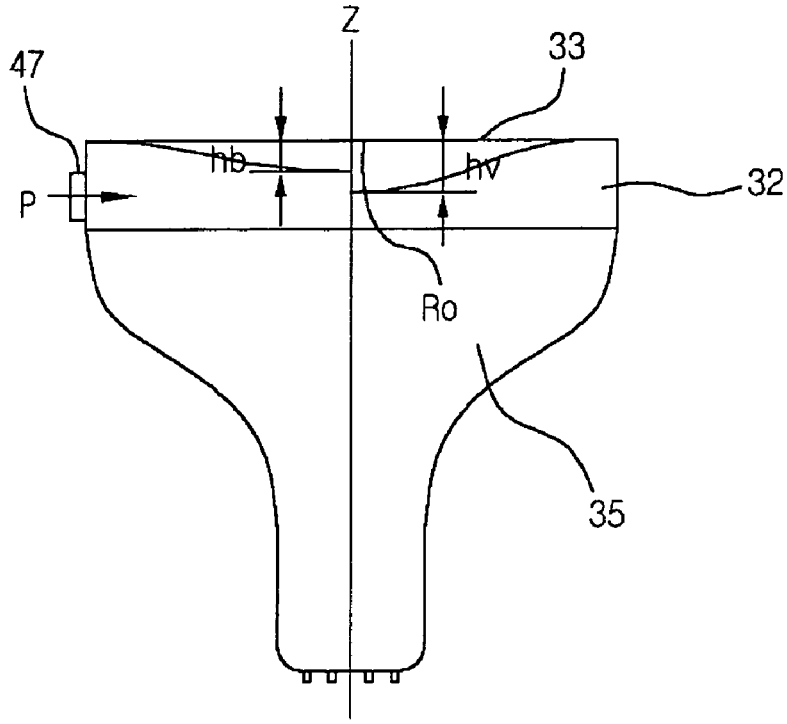
FIG. 15 illustrates a panel variation before/after mounting a reinforcing band in a cathode ray tube according to present invention.

FIG. 15 illustrates a panel variation before/after mounting a reinforcing band in a cathode ray tube according to present invention.

As shown in FIG. 15, if the reinforcing band 47 is mounted on an ideal position on the panel 33 having a substantially flat outer surface, the clamping power (P) of the reinforcing band 47 cancels the compressive stress acting on the central portion of the panel 33. In such case, a variation of the panel is reduced from 'hv' to 'hb'.

Table 3 describes restoration rates (or recovery rates) of the panel variation in accordance with the changes of b/a.

Here, the restoration rates (%) of the panel variation means the amounts of reduction of the panel variation, comparing the panel mounted with the reinforcing band 47 to the panel without the reinforcing band 47 thereon.

TABLE 3

| b/a | hv (μm) | hb (μm) | (hv − hb)/hv * 100 (%) |
|---|---|---|---|
| 1.0 | 123 | 115 | 7 |
| 1.2 | 123 | 92 | 25 |
| 1.5 | 123 | 89 | 28 |
| 1.8 | 123 | 91 | 26 |
| 2.5 | 123 | 115 | 7 |

As is apparent in Table 3, the restoration rate of the panel 33 variation changes, depending on the mounting position of the reinforcing band 47. For example, when the reinforcing band 47 is too close or too far from the panel 33, the clamping power (P) of the reinforcing band 47 cannot cancel the compressive stress acting on the central portion of the panel 33, and thus, the restoration rate is decreased.

Therefore, it is preferable to mount the reinforcing band 47 on a particular position to be able to satisfy the condition of $1.2<b/a<1.8$.

In conclusion, the cathode ray tube of the present invention has improved the landing stability of electron beams and the howling characteristic.

Another advantage of the present invention is that the explosion-proof characteristic of the reinforcing band is greatly improved.

Moreover, the cathode ray tube of the invention has improved the picture quality.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube comprising a panel having a skirt portion formed on a peripheral portion of an effective surface and a seal edge portion at an end of the skirt portion connected to a funnel, a stud pin being formed on an inner surface of the skirt portion and a band being mounted on an outer surface of the skirt portion, wherein the outer surface of the panel is substantially flat, the inner surface of the panel has a predetermined radius of curvature, a ratio of a distance (b) from the seal edge portion to an end of the band to a distance (a) from the seal edge portion to a center of the stud pin satisfies a condition of $1.0<b/a<2.0$.

2. The cathode ray tube according to claim 1, wherein a diagonal size of the effective surface of the panel is greater than 480 mm.

3. The cathode ray tube according to claim 1, wherein the ratio of the distance (b) from the seal edge to the end of the band to the distance (a) from the seal edge portion to the center of the stud pin satisfies a condition of $1.1<b/a<1.8$.

4. The cathode ray tube according to claim 1, wherein transmittance of glass at a central portion of the panel ranges from 45 to 75%.

5. The cathode ray tube according to claim 1, wherein a thickness of the band is less than 2.0 mm.

6. The cathode ray tube according to claim 5, wherein the thickness of the band ranges from 1.0 to 1.7 mm.

7. The cathode ray tube according to claim 1, wherein embossment is set on the band.

8. The cathode ray tube according to claim 7, wherein the band is a straight line-shaped band.

9. The cathode ray tube according to claim 1, wherein a wedge rate of the panel is greater than 170%.

10. The cathode ray tube according to claim 1, wherein radius of curvature of the inner surface of the panel ranges from 1.2R to 8R.

11. The cathode ray tube according to claim 3, wherein a width of the band is greater than 40 mm.

12. The cathode ray tube according to claim 7, wherein the embossment is set in a longitudinal direction of the band.

13. A cathode ray tube comprising a panel having a skirt portion formed on a peripheral portion of an effective surface and a seal edge portion at an end of the skirt portion connected to a funnel, a stud pin being formed on an inner surface of the skirt portion and a band being mounted on an outer surface of the skirt portion, wherein the outer surface of the panel is substantially flat, the inner surface of the panel has a predetermined radius of curvature, transmittance at a central portion of the panel ranges from 45 to 75%, a thickness of the band is less than 2.0 mm, and a ratio of a distance (b) from the seal edge portion to an end of the band to a distance (a) from the seal edge portion to a center of the stud pin satisfies a condition of $1.2<b/a<1.8$.

14. The cathode ray tube according to claim 13, wherein the thickness of the band ranges from 1.0 to 1.7 mm.

15. The cathode ray tube according to claim 13, wherein embossment is set on the band.

16. The cathode ray tube according to claim 15, wherein the embossment is set in a longitudinal direction of the band.

17. The cathode ray tube according to claim 13, wherein the width of the band is greater than 40 mm.

* * * * *